US006364644B1

(12) United States Patent
Saito

(10) Patent No.: US 6,364,644 B1
(45) Date of Patent: Apr. 2, 2002

(54) SCROLL-TYPE FLUID DISPLACEMENT APPARATUS

(75) Inventor: Satoru Saito, Takasaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/712,943

(22) Filed: Nov. 16, 2000

(30) Foreign Application Priority Data

Nov. 17, 1999 (JP) ..... 11-326196

(51) Int. Cl.[7] ..... F01C 1/02
(52) U.S. Cl. ..... 418/55.1
(58) Field of Search ..... 418/55.1

(56) References Cited

U.S. PATENT DOCUMENTS

| | | | | | |
|---|---|---|---|---|---|
| 4,432,708 | A | | 2/1984 | Hiraga et al. | |
| 4,575,319 | A | * | 3/1986 | Terauchi | 418/55.1 |
| 4,655,697 | A | * | 4/1987 | Nakamura et al. | 418/55.4 |
| 4,744,737 | A | * | 5/1988 | Yamamura et al. | 418/55.1 |

FOREIGN PATENT DOCUMENTS

| | | | | |
|---|---|---|---|---|
| JP | 59-079086 | * | 5/1984 | 418/55.1 |
| JP | 61-123790 | * | 6/1986 | 418/55.1 |
| JP | 62-282187 | * | 12/1987 | 418/55.1 |
| JP | 63-268995 | * | 11/1988 | 418/55.1 |
| JP | 03-206384 | * | 9/1991 | 418/55.1 |
| JP | 04-121477 | * | 4/1992 | 418/55.1 |
| JP | 04-234591 | * | 8/1992 | 418/55.1 |
| JP | 04-241786 | * | 8/1992 | 418/55.1 |
| JP | 04-334779 | * | 11/1992 | 418/55.1 |
| JP | 05-018202 | * | 1/1993 | 418/55.1 |
| JP | 05-149263 | * | 6/1993 | 418/55.1 |
| JP | 05-195967 | * | 8/1993 | 418/55.1 |
| JP | 06-042470 | * | 2/1994 | 418/55.1 |

* cited by examiner

*Primary Examiner*—Thomas Denion
*Assistant Examiner*—Theresa Trieu
(74) *Attorney, Agent, or Firm*—Baker Botts LLP

(57) ABSTRACT

A scroll-type compressor includes a fixed scroll and an orbiting scroll each having an end plate and a spiral element. Each of the spiral elements interfits and form at least one pair of sealed-off fluid pockets. The fixed scroll is connected to a front housing. A driving mechanism includes a drive shaft rotatably supported by the front housing. A first and a second pin hole for aligning of the fixed scroll and the orbiting scroll are formed in an end surface of the spiral element of the fixed scroll and in an end surface of the front housing, respectively, and the first pin hole formed in the fixed scroll and the second pin hole formed in the front housing have different diameters. The configuration of the scroll-type fluid compressor according to this invention may be finely adjusted to align the fixed scroll and the orbiting scroll.

6 Claims, 2 Drawing Sheets

SCROLL-TYPE FLUID DISPLACEMENT APPARATUS

BACKGROUND OF THE INVENTION

1. Field of the Invention

The present invention relates to the alignment of a fixed scroll and an orbiting scroll for a scroll-type fluid displacement apparatus.

2. Description of Related Art

Scroll-type fluid displacement apparatus are known in the art. The structure of a known scroll-type fluid displacement apparatus includes a housing and two scroll members an orbiting scroll and a fixed scroll, each having an end plate and a spiroidal or involute spiral wrap element extending from one side of each end plate. The housing comprises a front housing and a rear housing. The scroll members are maintained at an angular and radial offset, so that both spiral elements interfit to form a plurality of line contacts between their spiral curved surfaces to thereby seal off and define at least one pair of fluid pockets. The relative orbital motion of the two scroll members shifts the line contacts along the spiral curved surfaces and, as a result, changes the volume of the fluid pockets. The volume of the fluid pockets increases or decreases depending on the direction of orbital motion. Thus, this scroll-type apparatus is able to compress, expand, or pump fluids.

In the known scroll-type fluid displacement apparatus, two pin holes are formed in the fixed scroll or in the rear housing and the front housing, respectively, and two single diameter pins are inserted into each pin hole on the fixed scroll or the rear housing, and pin hole in the front housing. These pin holes are used to align the fixed scroll and the orbiting scroll, relative to each other.

In the known scroll-type fluid displacement apparatus, however, the alignment of the fixed scroll or the rear housing and front housing is unconditionally fixed, and the alignment of the fixed scroll and the orbiting scroll is unconditionally fixed. Therefore, the alignment of the fixed scroll and the orbiting scroll may not be finely adjusted to cope with the difference in part sizes within size tolerances. As a result, the efficiency of the compression of fluid may decrease, or the power of compression consumption may increase.

SUMMARY OF THE INVENTION

An object of the present invention is to provide a scroll-type fluid displacement apparatus which may permit fine adjustment to the alignment of a fixed scroll and an orbiting scroll.

In an embodiment, a scroll-type fluid displacement apparatus comprises a front housing, a fixed scroll, an orbiting scroll, and a driving mechanism. The fixed scroll has a first end plate and a spiral element formed on and extending from the first side of the first end plate. The fixed scroll is mounted on the front housing. The orbiting scroll has a second end plate and a spiral element formed on and extending from the first side of the second end plate. Each of the spiral elements interfits at an angular and a radial offset with the other to form a plurality of line contacts defining at least one pair of sealed-off fluid pockets. A driving mechanism includes a drive shaft rotatably supported by the front housing to effect the orbital motion of the orbiting scroll by rotation of the drive shaft and to thereby change the volume of the fluid pockets. Two pin holes are used for the alignment of the fixed scroll and the orbiting scroll. These pin holes are formed in an end surface of the spiral element of the fixed scroll and in an end surface of the front housing. The pin hole formed in the end surface of the spiral element of the fixed scroll and the pin hole formed in (or through) the end surface of the front housing have different diameters.

In another embodiment, a scroll-type fluid displacement apparatus comprises a rear housing and a front housing, a fixed scroll, an orbiting scroll, and a drive mechanism. The front housing closes the opening of the rear housing. The fixed scroll has a first end plate and a spiral element formed on and extending from the first side of the first end plate, and the fixed scroll is attached to the rear housing. The orbiting scroll has a second end plate and a spiral element formed on and extending from the first side of the second end plate. Each of the spiral elements interfits at an angular and a radial offset with the other to form a plurality of line contacts defining at least one pair of sealed-off fluid pockets. The driving mechanism includes a drive shaft, which is rotatably supported by the front housing. The rotation of drive shaft generates the orbital motion of the orbiting scroll, thereby changing the volume of the fluid pockets. Two pin holes are used for the alignment of the fixed scroll and the orbiting scroll. These pin holes are formed in an end surface of the rear housing and in an end surface of the front housing. The pin hole formed in the end surface of the rear housing and the pin hole formed in (or through) the end surface of the front housing have different diameters.

The structure of the scroll-type fluid displacement apparatus described in this invention permits the fine adjustment of the alignment of the fixed scroll and the orbiting scroll.

Other objects, features, and advantages will be apparent to persons of ordinary skill in the art from the following detailed description of the invention and the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Figure 1:
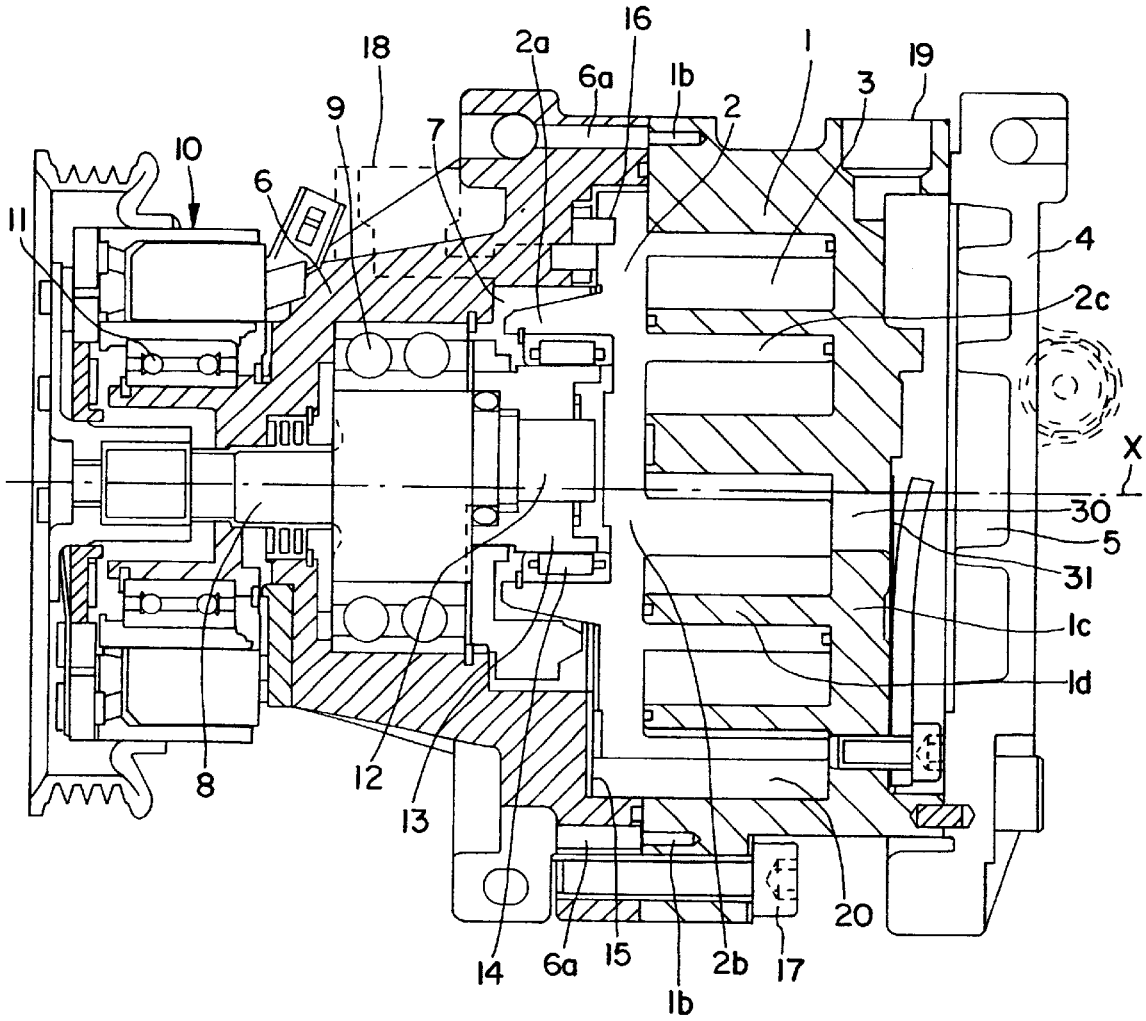
FIG. 1 is a longitudinal, cross-sectional view of a scroll-type fluid displacement apparatus in accordance with an embodiment of the present invention.

Referring to FIG. 1, scroll-type compressor includes rear casing 4, front housing 6, fixed scroll 1, and orbiting scroll 2. Fixed scroll 1 is secured to rear casing 4. Discharge chamber 5 is formed in rear casing 4 behind fixed scroll 1. Fixed scroll 1 includes disk-shaped first end plate 1*c* and first spiral element 1*d*. Fixed scroll 1 has discharge port 30, which is formed through first end plate 1*c* at a position near the center of first spiral element 1*d*. First spiral element 1*d* extends from the first end surface of first end plate 1*c*, which is opposite side of discharge chamber 5. First end plate 1*c* of fixed scroll 1 separates suction chamber 20 from discharge chamber 5 in rear casing 4. Inlet port 18 is formed on front housing 6 and communicates with suction chamber 20. Outlet port 19 is formed on fixed scroll 1 and communicates with discharge chamber 5.

Orbiting scroll 2 is located in front housing 6. Orbiting scroll 2 includes disk-shaped second end plate 2*b* and second spiral element 2*c*, which extends from the first end surface of second end plate 2*b*, and annular boss 2*a*, which is formed on and axially projects from the second end surface of second end plate 2*b*. First spiral element 1*d* of fixed scroll 1 and second spiral element 2*c* of orbiting scroll 2 interfit at an angular offset of 180 degrees and a predetermined radial offset. At least a pair of fluid pockets 3 are defined between fixed scroll 1 and orbiting scroll 2.

Front housing 6 is secured to fixed scroll 1 by a plurality of bolts 17. Crank chamber 7 is formed in front housing 6 behind orbiting scroll 2 and opposite second spiral element 2*c*.

Drive shaft 8 is disposed on a central axis of front housing 6 (i.e., the x-axis) and located in crank chamber 7. Drive shaft 8 is rotatably supported by front housing 6 through radial bearing 9. One end of drive shaft 8 projects from front housing 6. Electromagnetic clutch 10 is rotatably supported by front housing 6 through radial bearing 11. Crank pin 12 is connected eccentrically to another end of drive shaft 8. Crank pin 12 is inserted into annular boss 2*a* of orbiting scroll 2 and is connected into a disk-shaped eccentric bushing 13. Eccentric bushing 13 is rotatably disposed in the annular boss 2*a* through radial bearing 14. Thrust plate 15 is disposed between the second end surface of second end plate 2*b* of orbiting scroll 2 and an end surface of front housing 6.

Pin and ring coupling 16, which prevents orbiting scroll 2 from rotating, is disposed between second surface of second end plate 2*c* of orbiting scroll 2 and the end surface of front housing 6. Two smaller diameter pin holes (or recesses) 1*b*, each of which has a bottom, are formed in a flange surface portion of fixed scroll 1. These smaller diameter pin holes 1*b* are positioned in the opposite side of the flange surface portion of fixed scroll 1, respectively. Two larger diameter pin holes (or recesses) 6*a*, which are penetrating holes, are formed through a flange of the end surface of front housing 6 and correspond to smaller diameter pin hole 1*b*. These larger diameter pin holes 6*a* are positioned through the opposite sides of a flange of the end surface of front housing 6, respectively.

When a driving force is transferred from an external driving source (e.g., an engine of a vehicle) via electromagnetic clutch 10, drive shaft 8 is rotated, and orbiting scroll 2, which is supported by crank pin 12, is driven in an orbital motion about the x-axis by the rotation of drive shaft 8. Pin and ring coupling 16 prevents the rotation of orbiting scroll 2 with respect to fixed scroll 1. When orbiting scroll 2 is driven in an orbital motion, fluid pockets 3, which are defined between first spiral element 1*d* of fixed scroll 1 and second spiral element 2*c* of orbiting scroll 2, move from the outer or prepheral portions of the spiral elements to the central portion of the spiral elements. Refrigerant gas, which enters suction chamber 20 through inlet port 18, flows into one of fluid pockets 3. When fluid pockets 3 move from outer portions of the spiral elements to the central portion of the spiral element, the volume of fluid pockets 3 is reduced, and refrigerant gas in fluid pockets 3 is compressed. Compressed refrigerant gas confined within fluid pockets 3 moves to discharge port 30, displaces a reed valve 31, and is discharged through discharge port 30 into discharge chamber 5. Finally, the compressed refrigerant gas passes into an external refrigerant circuit (not shown) through outlet port 19.

If the alignment of fixed scroll 1 and orbiting scroll 2 in a plane perpendicular to the x-axis is not appropriate, a clearance between a side wall of first spiral element 1*d* of fixed scroll 1 and a side wall of second spiral element 2*c* of orbiting scroll 2 may be too large or too small. This may cause a decrease of the efficiency of the compression and an increase in the power of compression consumption. The size of the scrolls and other parts of the compressor may vary within a predetermined size tolerance. Therefore, when a scroll compressor is manufactured, the alignment of the fixed scroll 1 and the orbiting scroll 2 in a plane perpendicular to the x-axis is finely adjusted to within a desired range in every scroll compressor. The alignment of fixed scroll 1 and orbiting scroll 2 in a plane perpendicular to the x-axis is defined by an alignment of fixed scroll 1 and front housing 6 in a plane perpendicular to the x-axis.

In this invention of a scroll-type fluid displacement apparatus, each of smaller diameter holes 1*b* and larger diameter holes 6*a* faces and corresponds to one of the other. When fixed scroll 1 and front housing 6 are assembled, a pin is used to insert into smaller diameter hole 1*b* and larger diameter hole 6*a*. The pin has a smaller diameter portion, which fits smaller diameter hole 1*b*, and a larger diameter portion, which fits larger diameter hole 6*a*. Each such pin results in a different alignment of the smaller diameter portion and larger diameter portion. As shown in FIGS. 2*a*–2*e*, by preparing a plurality of pins, which have a different alignment of the smaller diameter portion and larger diameter portion, and by selecting an appropriate pin therefrom, the alignment of smaller diameter hole 1*b* and larger diameter hole 6*a* in a plane perpendicular to the x-axis may be finely adjusted. Therefore, an alignment of fixed scroll 1 and front housing 6 in a plane perpendicular to the x-axis is finely adjusted, and an alignment of fixed scroll 1 and orbiting scroll 2 in a plane perpendicular to the x-axis may be finely adjusted.

Figure 2A:
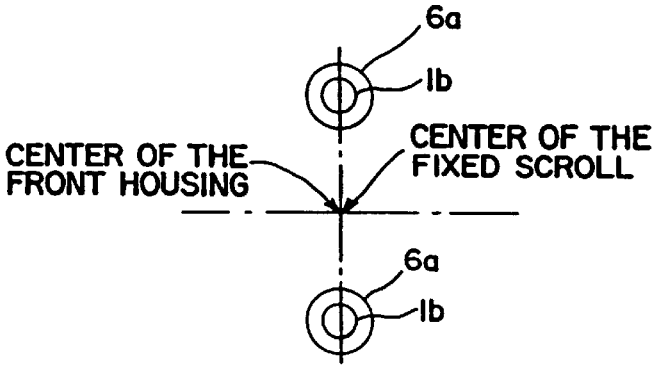
FIGS. 2*a*–2*e* depict the alignment of a smaller diameter pin hole or recess having a bottom and formed in a fixed scroll with a larger diameter penetrating pin hole formed in (or through) the front housing.
Figure 2B:
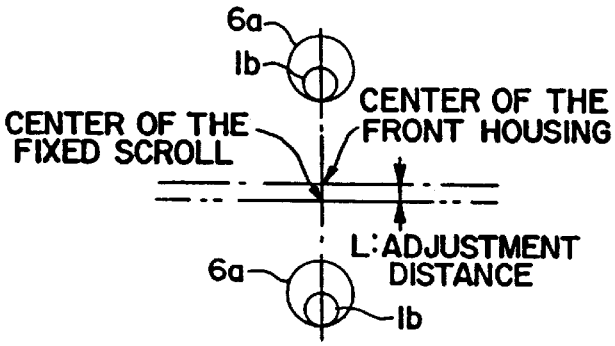
Figure 2C:
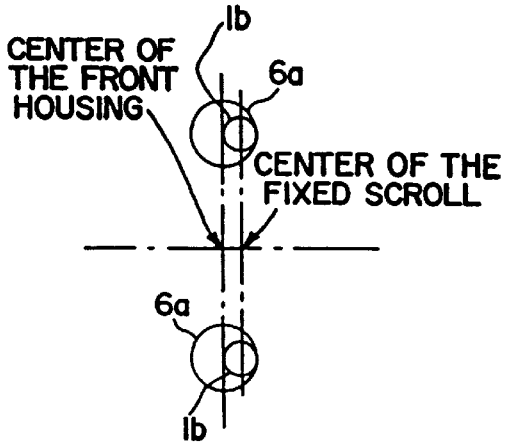
Figure 2D:
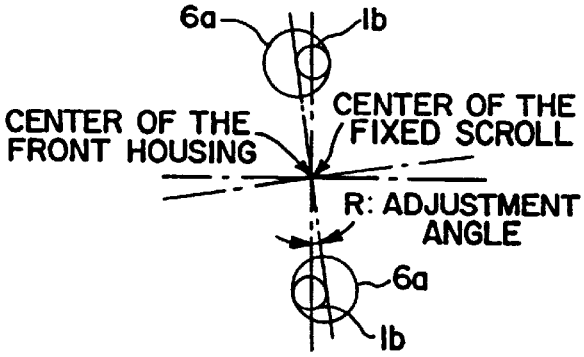
Figure 2E:
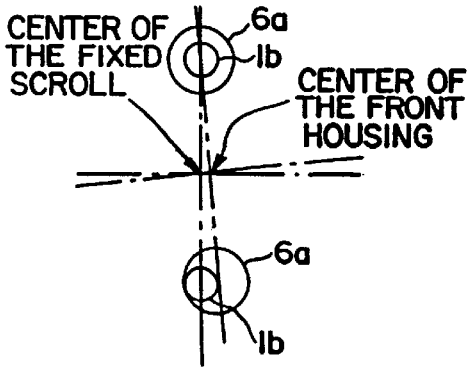

FIG. 2*a* depicts a situation in which the center of fixed scroll 1 and the center of front housing 6 correspond, and the center of smaller diameter pin hole 1*b* and the center of larger diameter pin hole 6*a* correspond, and a desired alignment of fixed scroll 1 and orbiting scroll 2 may be achieved. FIGS. 2*b* and 2*c* depict a situation in which front housing 6 moves in parallel against fixed scroll 1 from the condition depicted in FIG. 2*a* because of a tolerance between these parts, and an appropriate alignment of fixed scroll 1 and orbiting scroll 2 may be achieved. FIG. 2*d* depicts a situation in which front housing 6 moves in rotation against fixed scroll 1 from the condition depicted in FIG. 2*a* because of a tolerance between these parts, and an appropriate alignment of fixed scroll 1 and orbiting scroll 2 may be achieved. FIG. 2*e* depicts a situation in which front housing 6 moves in parallel and rotation against fixed scroll 1 from the condition depicted in FIG. 2*a* because of a tolerance between these parts, and an appropriate alignment of fixed scroll 1 and orbiting scroll 2 may be achieved.

After the alignment of fixed scroll 1 and front housing 6 is finely adjusted, and the alignment of fixed scroll 1 and orbiting scroll 2 is finely adjusted, a plurality of bolts 17 are inserted into a plurality of penetrating holes formed through fixed scroll 1. Bolts 17 are threaded into the plurality of threaded holes formed on the end surface of front housing 6, and front housing 6 is secured to fixed scroll 1. The plurality of penetrating holes, which are used to be penetrated by a plurality of bolts 17, have sufficient diameter to absorb a fine adjustment of the alignment of fixed scroll 1 and front housing 6.

After front housing 6 is secured to fixed scroll 1, the two pins, which are used to adjust the alignment of fixed scroll 1 and front housing 6, are no longer required and removed from the side of larger diameter hole 6*a*. Therefore, parts, which are no longer required in the scroll-type fluid displacement apparatus, are removed from it. As a result, the number of parts of the scroll-type fluid displacement apparatus may be reduced, and the manufacturing cost of the scroll-type fluid displacement apparatus also may be reduced.

Because smaller diameter pin hole (or recesses) 1*b* has a bottom and does not penetrate through fixed scroll 1, weakening of fixed scroll 1 may be prevented. In the above-described apparatus, front housing 6 is secured to fixed scroll 1. However, a scroll-type displacement apparatus, which has a structure, such that a front housing is secured to a rear housing and which secures a fixed scroll, is within contemplation of the present invention.

In the above-described apparatus, two smaller diameter pin holes 1*b* (or recesses), each of which has a bottom, are formed in fixed scroll 1 and two larger diameter pin holes 6*a*, which are penetrating holes, are formed through the end surface of front housing 6. However, forming two larger diameter pin holes, which are penetrating holes, through fixed scroll 1 and forming two smaller diameter pin holes, each of which has a bottom, in the end surface of front housing 6 are within contemplation of the present invention. In this embodiment, because each smaller diameter pin hole 1*b* has a bottom and does not penetrate through front housing 6, weakening of front housing 6 may be prevented.

As described above, in the embodiments of the present invention of a scroll-type fluid displacement apparatus, the diameter of two pin holes 1*b* formed in fixed scroll 1 or in the rear housing and the diameter of two pin holes 6*a* formed through front housing 6 are different. Therefore, if a plurality of pins, each of which has a smaller diameter portion and a larger diameter portion and differing alignments between these portions, are prepared, the alignment of fixed scroll 1 or the rear housing and front housing 6 may be finely adjusted, and the alignment of fixed scroll 1 and orbiting scroll 2 may be finely adjusted.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A scroll-type fluid displacement apparatus comprising:

a fixed scroll having a first end plate and a spiral element formed on and extending from a first side of said first end plate, said fixed scroll being mounted on a front housing;

an orbiting scroll, having a second end plate and a spiral element formed on and extending from a first side of said second end plate, each of said spiral elements interfitting at an angular and a radial offset to form a plurality of line contacts defining at least one pair of sealed-off fluid pockets; and a driving mechanism including a drive shaft rotatably supported by said front housing to effect the orbital motion of said orbiting scroll by rotation of said drive shaft and to thereby change the volume of said fluid pockets, wherein at least one first pin hole and at least one second pin hole for aligning said fixed scroll and said orbiting scroll and are formed in an end surface of said spiral element of said fixed scroll and in an end surface of said front housing, respectively, and said at least one first pin hole formed in said end surface of said spiral element of said fixed scroll and said at least one second pin hole formed in said end surface of said front housing have different diameters.

2. The scroll-type fluid displacement apparatus of claim 1, wherein a pair of said first pin holes are formed through said end surface of said spiral element of said fixed scroll and have diameters larger than a corresponding pair of said second pin holes formed in said end surface of said front housing.

3. The scroll-type fluid displacement apparatus of claim 1, wherein a pair of said first pin holes are formed through said end surface of said spiral element of said fixed scroll and have diameters smaller than a corresponding pair of said second pin holes formed in said end surface of said front housing.

4. A scroll-type fluid displacement apparatus comprising:

a rear housing having an open end;

a front housing closing said opening;

a fixed scroll having a first end plate and a spiral element formed on and extending from a first side of said first end plate, said fixed scroll being attached to said rear housing;

an orbiting scroll, having a second end plate and a spiral element formed on and extending from a first side of said second end plate, each of said spiral elements intermitting at an angular and a radial offset to form a plurality of line contacts defining at least one pair of sealed-off fluid pockets; and a driving mechanism including a drive shaft rotatably supported by said front housing to effect the orbital motion of said orbiting scroll by rotation of said drive shaft to thereby change the volume of said fluid pockets, wherein at least one first pin hole and at least one second pin hole for aligning said fixed scroll and said orbiting scroll and are formed in an end surface of said rear housing and in an end surface of said front housing, respectively, and said at least one first pin hole formed in said end surface of said rear housing and said at least one second pin hole formed in said end surface of said front housing have different diameters.

5. The scroll-type fluid displacement apparatus of claim 4, wherein a pair of said first pin holes are formed through said end surface of said rear housing and have diameters larger than a corresponding pair of said second pin holes formed in said end surface of said front housing.

6. The scroll-type fluid displacement apparatus of claim 4, wherein a pair of said first pin holes are formed in said end surface of said rear housing and have diameters smaller than a corresponding pair of said second pin holes formed in said end surface of said front housing.

* * * * *